US008992293B1

(12) United States Patent
Finkelstein

(10) Patent No.: US 8,992,293 B1
(45) Date of Patent: Mar. 31, 2015

(54) VENTILATOR

(75) Inventor: Burl Finkelstein, Newnan, GA (US)

(73) Assignee: Kason Industries, Inc., Newnan, GA (US)

( * ) Notice: Subject to any disclaimer, the term of this patent is extended or adjusted under 35 U.S.C. 154(b) by 2114 days.

(21) Appl. No.: 11/483,308

(22) Filed: Jul. 7, 2006

(51) Int. Cl.
*F24F 7/00* (2006.01)

(52) U.S. Cl.
USPC ..... 454/322

(58) Field of Classification Search
USPC ..... 454/339, 322, 195, 333, 305, 340, 173, 454/308, 255, 341, 64, 270, 271, 272, 212; 55/473
See application file for complete search history.

(56) References Cited

U.S. PATENT DOCUMENTS

| | | | | | |
|---|---|---|---|---|---|
| 2,996,138 | A | * | 8/1961 | Schwartz et al. | 181/284 |
| 3,813,896 | A | | 6/1974 | Lebahn | |
| 3,952,542 | A | * | 4/1976 | Berkowitz | 62/409 |
| 4,257,445 | A | * | 3/1981 | Cook et al. | 137/341 |
| 4,499,917 | A | * | 2/1985 | Fujiya | 137/341 |
| 4,662,270 | A | * | 5/1987 | Fiddler et al. | 454/195 |
| 4,690,372 | A | * | 9/1987 | Thiebaud | 251/129.1 |
| 4,759,198 | A | * | 7/1988 | Yamada | 62/409 |
| 5,421,775 | A | | 6/1995 | Honda | |
| 5,775,124 | A | * | 7/1998 | Park et al. | 62/408 |
| 5,836,170 | A | * | 11/1998 | Perkins et al. | 62/409 |
| 6,029,470 | A | * | 2/2000 | Joo et al. | 62/408 |
| 6,131,403 | A | * | 10/2000 | Ji | 62/186 |
| 6,176,776 | B1 | | 1/2001 | Finkelstein et al. | |
| 6,422,031 | B1 | * | 7/2002 | Mandel et al. | 62/408 |
| 2003/0131541 | A1 | * | 7/2003 | Lee et al. | 52/79.1 |
| 2005/0081555 | A1 | * | 4/2005 | Seiss | 62/410 |

* cited by examiner

*Primary Examiner* — Steven B McAllister
*Assistant Examiner* — Brittany Towns
(74) *Attorney, Agent, or Firm* — Dorian B. Kennedy; Baker Donelson

(57) ABSTRACT

A ventilator (10) is disclosed which includes a ventilator intake hood (11), a pressure relief valve block (12), and a nozzle plate (13). The pressure relief valve block includes a field of pressure relief valves (19) positioned within air channels (20). The nozzle plate includes a field of fourteen nozzles (22) which are aligned with an air channel of the block. Each nozzle defines an interior passage (23) which tapers inwardly as it extends outwardly along the direction of airflow. The nozzles accelerate the airflow so that moisture within the air entering the cooled enclosure does not immediately freeze upon the adjoining enclosure to form an ice block.

6 Claims, 3 Drawing Sheets

VENTILATOR

TECHNICAL FIELD

This invention relates to pressure relief ventilators used on temperature controlled enclosures such as walk-in freezers and test chambers.

BACKGROUND OF THE INVENTION

Many temperature controlled commercial enclosed spaces need to be equipped with pressure relief ports or vents which are sometimes referred to as ventilators or ventilator ports. This is particularly true where the sealed space is subjected to temperature related gas volume variations that must be relieved.

Many of these enclosed spaces require that a positive air pressure differential to ambience be maintained. However there are spaces where no differential is required or desired. Passive ports are suitable for these enclosures. However existing passive pressure relief ports, meaning those without fans or blowers, have often permitted air migration where there is no significant pressure differential. With walk-in freezers this causes undesirable condensation and frosting. Frosting is a substantial problem that occurs as ambient warm air drawn into a low temperature chamber releases significant amounts of moisture relative to the change in dew point of the air at high and low temperatures. Air is drawn through the port after each door opening cycle as the warm air that entered the enclosure cools and contracts. If venting does not occur, a partial vacuum results which make it difficult to reopen the door. In extreme cases, the enclosures can even collapse.

A temperature rise in the enclosure between cooling cycles, and especially during a defrost cycle, creates a need to vent air to prevent pressure buildup. Again, failure to vent this pressure, with adequate relief capacity, can cause the chamber to rupture.

Passive pressure relief ports are in wide commercial use today. Large structures require the movement of a large amount of air to equalize the pressure between the inside and the outside of the enclosure. Existing vents can be either of a large size or a gang of small sized vents. This large amount of air carries with it a large amount of moisture. This moisture can condense almost immediately upon contact with the cold air and cold surfaces of the enclosure. If this occurs, a large ice block may form on the interior wall, which may eventually block the inflow of air through the port. This large ice block may also pose a potential danger to someone should it fall from the wall.

Accordingly, it is seen that a need exists for a passive pressure relief port, i.e. one that is not electrically powered by fans and baffles, yet which substantially prevents the formation of ice blocks within the enclosure. It thus is to be provision of such a pressure relief port that the present invention is primarily directed

SUMMARY OF THE INVENTION

In a preferred form of the invention a freezer ventilator comprises an air intake, a gang of air control valves, and a gang of air nozzles. Each air nozzle is associated with one air control valve. With this construction, the air nozzles accelerate an airstream there through to restricts the formation of ice adjacent the nozzle.

DETAILED DESCRIPTION

Figure 1:
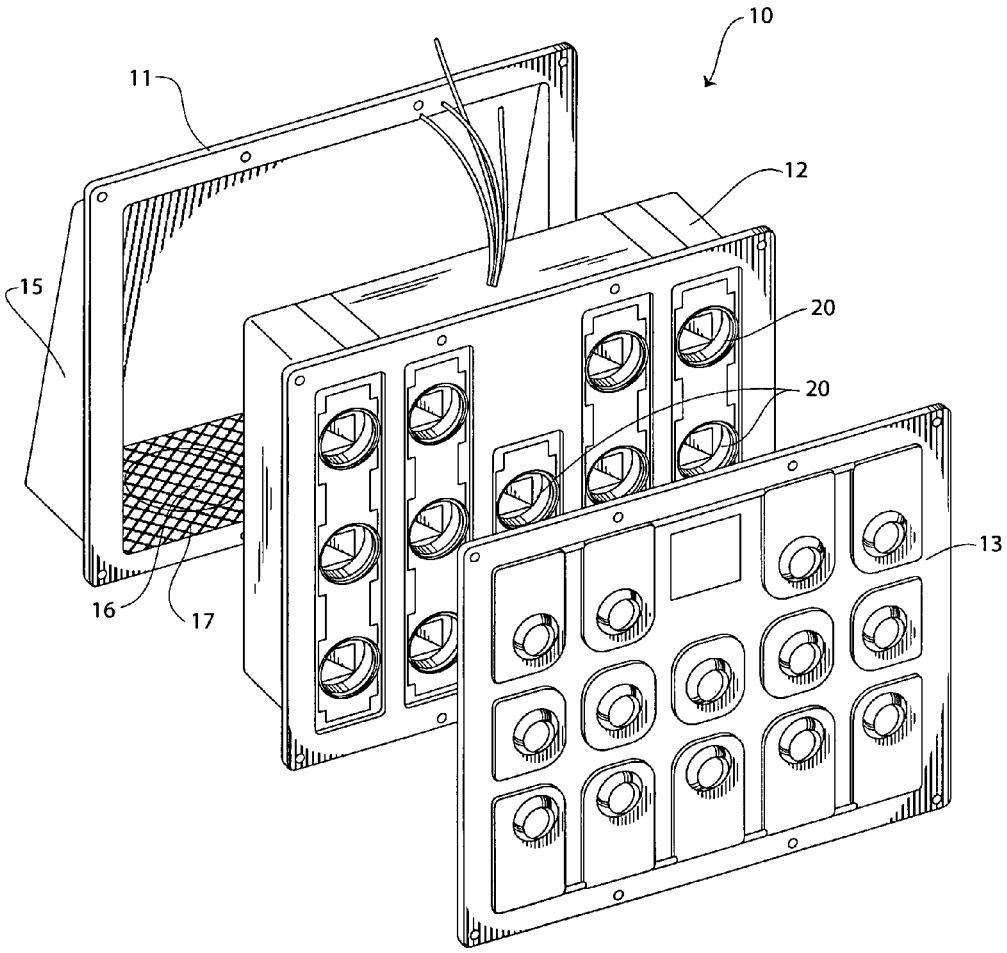
FIG. 1 is a perspective view of a freezer ventilator that embodies principles of the invention in its preferred form, shown in a position mounted to a ceiling.
Figure 2:
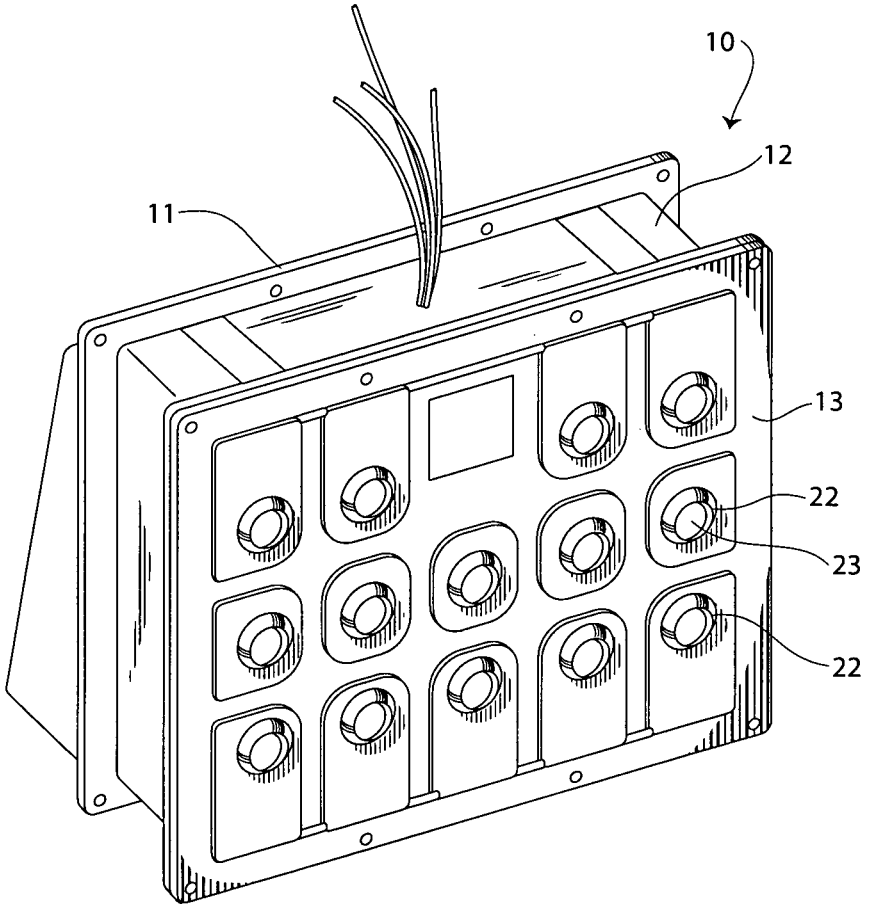
FIG. 2 is an exploded, perspective view of the freezer ventilator shown in FIG. 1.

With reference next to the drawings, there is shown a ventilator 10 in a preferred form of the invention. The ventilator 10 is used with a temperature controlled enclosure, such as a freezer. The ventilator 10 includes a ventilator intake hood 11, a pressure relief valve block 12, and a nozzle plate 13.

The intake hood 11 has a flared portion 15 having a series of intake holes 16 therein. A screen mesh 17 is positioned over the intake holes 16 to prevent insects and other foreign objects from entering the ventilator.

The pressure relief valve block 12 includes a gang or field of fourteen pressure relief valves 19 each positioned within a separate air channel 20. Each pressure relief valve is the same as that depicted in U.S. Pat. No. 6,176,776, which is specifically incorporated herein.

Figure 3:
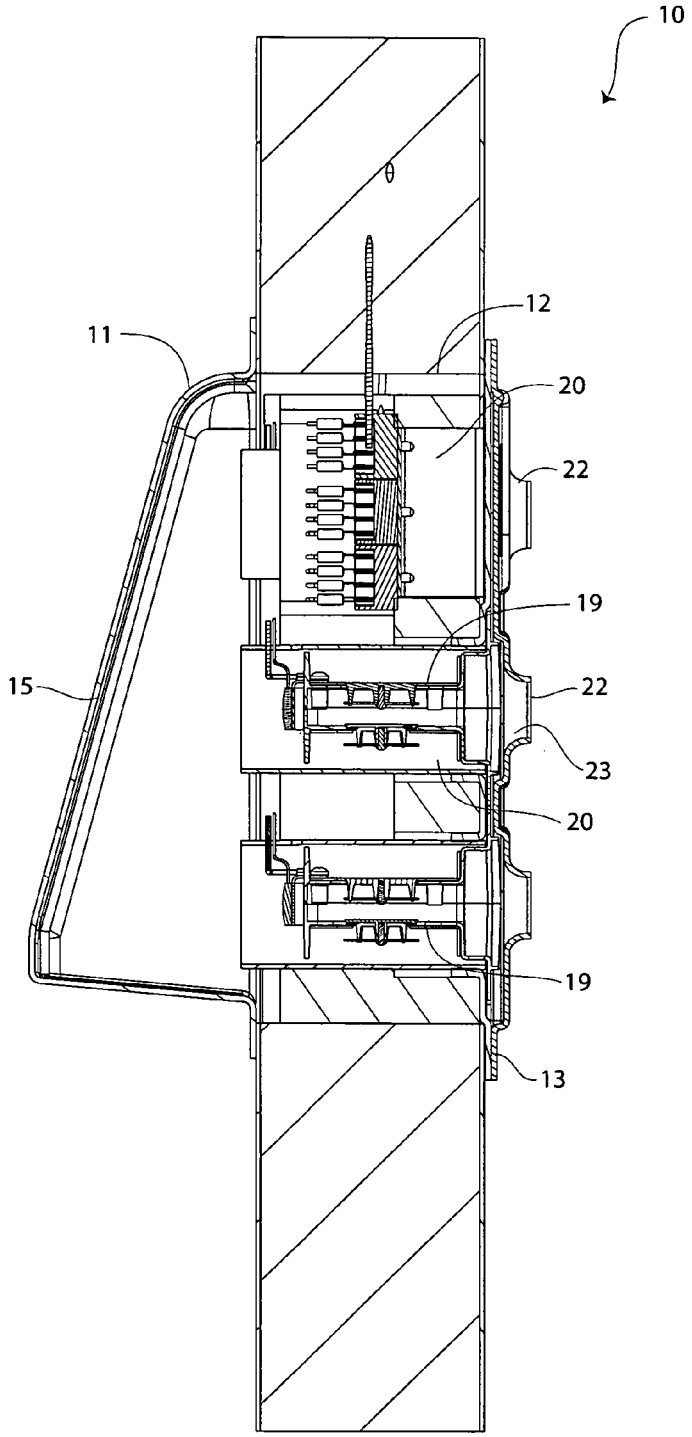
FIG. 3 is a partial cross-sectional view of the freezer ventilator shown in FIG. 1.

The nozzle plate 13 includes a gang or field of fourteen nozzles 22. Each nozzle 22 is aligned with an air channel 20 of relief valve block 12. Each nozzle 22 defines an interior passage 23 which tapers inwardly as it extends outwardly along the direction of airflow indicated by the arrows in FIG. 3.

In use, air flows into the ventilator 10 by passing through intake holes 16 within the intake hood. This air is divided into multiple airstreams which pass through air channels 20 and pressure relief valves 19, as described in more detail in U.S. Pat. No. 6,176,776. The multiple airstreams then pass into an enlarged portion of the channels 20 adjacent the nozzles 22, and finally into the cooled enclosure through nozzles 22. The enlarged portion of the channel 20 immediately before the narrowing nozzles 22 causes the airflow there through to accelerate through the nozzles 22.

It has been discovered that with the addition of the nozzle the airflow or airstream into the cooled enclosure is accelerated as it passes through the nozzle. Hence, the airstream is expelled from the ventilator with a greater velocity than an airstream utilizing control valves alone. This increase in airstream velocity restricts the formation of ice upon the wall or ceiling adjacent the ventilator. As such, the moisture within the air freezes away from the wall, thereby creating small ice crystals that may be carried with the airstream to the refrigeration coils or other area where they will not accumulate in a harmful manner. Ice crystals captured upon the refrigeration coils may be expelled during normal defrost cycles of the refrigeration equipment.

It should be understood that any number of channels 20, valves 19 and nozzles 22 may be utilized in practicing the invention. The number of such elements is dependent upon the volume of the desired airflow. It should also be understood that other types of valves and/or number of valves in relationship to the number of nozzles may be utilized as an alternative to that shown in the preferred embodiment.

It thus is seen that a ventilator is now provided which avoids the formation of an ice block upon the adjoining enclosure walls or ceiling. Though it has been described in detail in its preferred form, it should be realized that many modifications, additions and deletions may be made without departure from the spirit and scope of the invention as set forth in the following claims.

The invention claimed is:

1. A ventilator adapted to be mounted to a wall of a building comprising:

an air intake hood adapted to be mounted to an exterior side of a building wall;

a gang of individual air channels extending from said air intake, each said air channel having an exit end having a size for air flow in one direction from said air intake to said exit end;

a gang of air control valves, allowing airflow only in the one direction each air control valve being mounted within one said individual air channel of said gang of individual air channels; and a plate having a gang of air accelerating air nozzles adapted to be mounted to an interior side of the wall opposite said air intake, each said air nozzle being positioned in close proximity to said exit end of one said individual air channel of said gang of individual air channels opposite said air intake and being positioned adjacent one said air control valve, each said air accelerating air nozzle having a size smaller than said air channel size, whereby the air accelerating air nozzles accelerate an airstream there through to restricts the formation of ice adjacent the nozzle.

2. The ventilator of claim 1 wherein said nozzles include an inwardly tapering passage.

3. A ventilator adapted to be mounted to a wall of a building comprising:

an air intake hood adapted to be mounted to an exterior side of a building wall;

a valve block coupled to said air intake, said block defining a plurality of individual air channels, each said air channel having an exit end having a size for air flow in one direction from said air intake to said exit end;

a plurality of air control valves, allowing airflow only in the one direction each air control valve being coupled with one individual air channel;

a nozzle plate coupled with said valve block, said nozzle plate including a plurality of air accelerating air nozzles, each said air accelerating air nozzle being positioned in close proximity to said exit end of one said air channel opposite said air intake, each said air accelerating nozzle having a size smaller than said air channel size, whereby an airstream passing through each air channel is accelerated by the air accelerating nozzle to restrict the formation of ice adjacent the nozzle.

4. The ventilator of claim 3 wherein each said nozzle includes an inwardly tapering passage.

5. The ventilator of claim 3 wherein each said nozzle is longitudinally aligned with one said air channel.

6. The ventilator of claim 1 wherein each said nozzle is longitudinally aligned with one said air channel.

* * * * *